US006782235B2

(12) United States Patent
Serizawa et al.

(10) Patent No.: US 6,782,235 B2
(45) Date of Patent: Aug. 24, 2004

(54) IMAGE FORMATION APPARATUS AND DEVELOPER COLLECTION VESSEL USED THEREWITH

(75) Inventors: Masato Serizawa, Saitama (JP); Katsumi Harumoto, Saitama (JP); Kouji Hamabe, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/367,929

(22) Filed: Feb. 19, 2003

(65) Prior Publication Data

US 2003/0219292 A1 Nov. 27, 2003

(30) Foreign Application Priority Data

May 21, 2002 (JP) ..... P2002-145661

(51) Int. Cl.[7] ..... G03G 21/12
(52) U.S. Cl. ..... 399/360; 399/358; 399/120
(58) Field of Search ..... 222/DIG. 1; 399/120, 399/257, 258, 299, 358, 359, 360

(56) References Cited

U.S. PATENT DOCUMENTS 5,708,952 A * 1/1998 Taniguchi et al. ..... 399/358
5,933,690 A * 8/1999 Sugimoto et al. ..... 399/257

FOREIGN PATENT DOCUMENTS

JP 406214496 * 8/1994
JP 2912073 B2 9/1999

* cited by examiner

*Primary Examiner*—Hoang Ngo
(74) *Attorney, Agent, or Firm*—Morgan, Lewis & Bockuis LLP

(57) ABSTRACT

A collection vessel 124 has a shutter 138 for opening and closing collection ports 136. A rotation shaft 140 of the shutter 138 is provided with an opening/closing piece 144. The opening/closing piece 144 abuts a protrusion on an image formation apparatus main unit and opens the shutter 138 largely so that a discharge section inserted into the collection port 136 does not abut. The collection port 136 is made a long hole so as to allow the discharge section to move. Further, the shutter 138 is formed integrally with a plurality of door parts 142 so as to open or close the collection ports 136 by one operation.

16 Claims, 13 Drawing Sheets

IMAGE FORMATION APPARATUS AND DEVELOPER COLLECTION VESSEL USED THEREWITH

BACKGROUND OF THE INVENTION

1. Technical field of the Invention

This invention relates to a developer collection vessel for collecting waste toner, a developer collected from a developing machine adopting a trickle developing system, or the like and an image formation apparatus comprising the developer collection vessel.

2. Description of the Related Art

In an electrophotographic image formation apparatus applied to a printer, a copier, etc., developers to be discharged occur in a photoconductor, a transfer roll, a developing machine, etc., and need to be collected, and a developer collection vessel is placed.

Hitherto, as an image formation apparatus comprising this kind of developer collection vessel, an apparatus has been disclosed in Japanese Patent No. 2912073. In the related art example, a plurality of collected developer occurrence sections are connected to a discharge section via a transport passage and the discharge section is connected to a collection port formed in the collection vessel so as to collect collected developers occurring from the collected developer occurrence sections.

When the collection vessel becomes full of the developers, it needs to be replaced and thus the collection vessel being full of the developers is detached from the discharge section and a new collection vessel is attached. In this case, to prevent the developer from spilling from the discharge section, it is possible to provide the collection vessel with a shutter for opening/closing the collection port. It may be common practice to abut the discharge section against the shutter when the collection vessel is attached and open the shutter in association with attachment of the collection vessel.

However, when the collection vessel is detached, the shutter needs to be closed to prevent the developer from spilling from the collection port and thus the shutter is urged in a direction closing the collection port using a spring, etc. Thus, when the collection vessel is attached, a press force is placed on the discharge section from the shutter and the press force on the discharge section is transmitted to a collected developer occurrence section. If the collected developer occurrence section is cleaned with a blade, for example, there is a fear of causing a blade nip failure, etc., to occur. If the collected developer occurrence section is movable, for example, if the image formation apparatus comprises a magnet roll of a developing machine detachable from a photoconductor and the developing machine is provided with the collected developer occurrence section, when the discharge section abuts the shutter, it is feared that the pressure acting on the discharge section from the shutter may hinder a move of the developing machine.

SUMMARY OF THE INVENTION

It is a first object of the invention to prevent pressure of a shutter from being placed on a discharge section in a developer collection vessel having the shutter. It is a second object of the invention to make it possible to allow a discharge section to move. It is a third object of the invention to simplify a mechanism for opening and closing a collection port including a shutter.

To the ends, according to a first aspect of the invention, there is provided an image formation apparatus comprising a collected developer occurrence section, a discharge section being connected to the collected developer occurrence section, a collection vessel having a collection port into which the discharge section is inserted and a shutter urged in a direction closing the collection port, and retreat means for retreating the shutter to a position where the discharge section does not abut the shutter with the discharge section inserted in the collection port. Therefore, the retreat means retreats the shutter to a position where the shutter does not abut the discharge section with the discharge section inserted in the collection port, so that pressure of the shutter can be prevented from being placed on the discharge section.

The collected developer occurrence sections are placed in the developing machines, the photoconductors, the intermediate transfer bodies, the transfer roll, etc., and are formed as developer discharge passages and cleaning means. Each developing machine adopts a trickle developing system, for example, and to collect an extra developer, the developer is collected into the collection vessel. The collected developer occurrence sections are placed so that they can be moved in any other direction than the insertion axial direction of the discharge section; for example, if the collected developer occurrence section is placed in the developing machine, it is placed so that it can be moved in a direction coming in or out of contact with the photoconductor. If the discharge section is moved together with the collected developer occurrence section, the collection port is formed as a shape for allowing the discharge section to move. The collection port is shaped like a long hole, for example. Preferably, the shutter is retreated to a position where the shutter does not interfere with the discharge section in the movable range of the discharge section. To place the collection vessel on an image formation apparatus main unit, the collection vessel is not necessarily placed straightly on the image formation apparatus main unit. Thus, if the collection vessel is placed slantingly on the image formation apparatus main unit, preferably the discharge section first abuts and the shutter is opened so as not to hinder opening the shutter. Further, the retreat means may have a configuration for enabling the shutter urged in the closing direction to be moved to the retreat position. A protrusion may be provided in the image formation apparatus main unit for moving the shutter or the shutter can also be moved in conjunction with the cover of the image formation apparatus main unit.

According to a second aspect of the invention, there is provided an image formation apparatus comprising a plurality of collected developer occurrence sections, a plurality of discharge sections being connected to the plurality of collected developer occurrence sections, and a collection vessel having a plurality of collection ports into which the plurality of discharge sections are inserted and a shutter urged in a direction closing the plurality of collection ports, wherein the shutter opens and closes the plurality of collection ports in one piece. Therefore, one shutter may be used to open and close the plurality of collection ports, so that the number of parts can be lessened and the opening/closing mechanism can be simplified.

According to a third aspect of the invention, there is provided an image formation apparatus comprising a collected developer occurrence section, a discharge section being connected to the collected developer occurrence section, and a collection vessel formed with a collection port into which the discharge section is inserted, wherein the discharge section is moved in any other direction than the insertion axial direction of the discharge section into the collection port and the collection port is formed as a shape for allowing the discharge section to move. Therefore, the discharge section can move the collection port freely, so that load can be prevented from being imposed on the collected developer occurrence section.

According to a fourth aspect of the invention, there is provided an image formation apparatus comprising a photoconductor, a developing machine being placed so that the developing machine can be brought into and out of contact with the photoconductor, and a collection vessel formed with a collection port into which a discharge section connected to a collected developer occurrence section placed in the developing machine is inserted, wherein the collection port is formed as a shape for allowing the discharge section to move as the developing machine is brought into and out of contact with the photoconductor. Although a magnet roll of the developing machine is brought away from the photoconductor when the image formation operation is not performed, the discharge section connected to the developing machine can move the collection port freely, so that the developing machine can be moved smoothly.

According to another aspect of the invention, there is provided a developer collection vessel used with the image formation apparatus described above.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Referring now to the accompanying drawings, preferred embodiments of the invention will be described below.

Figure 1:
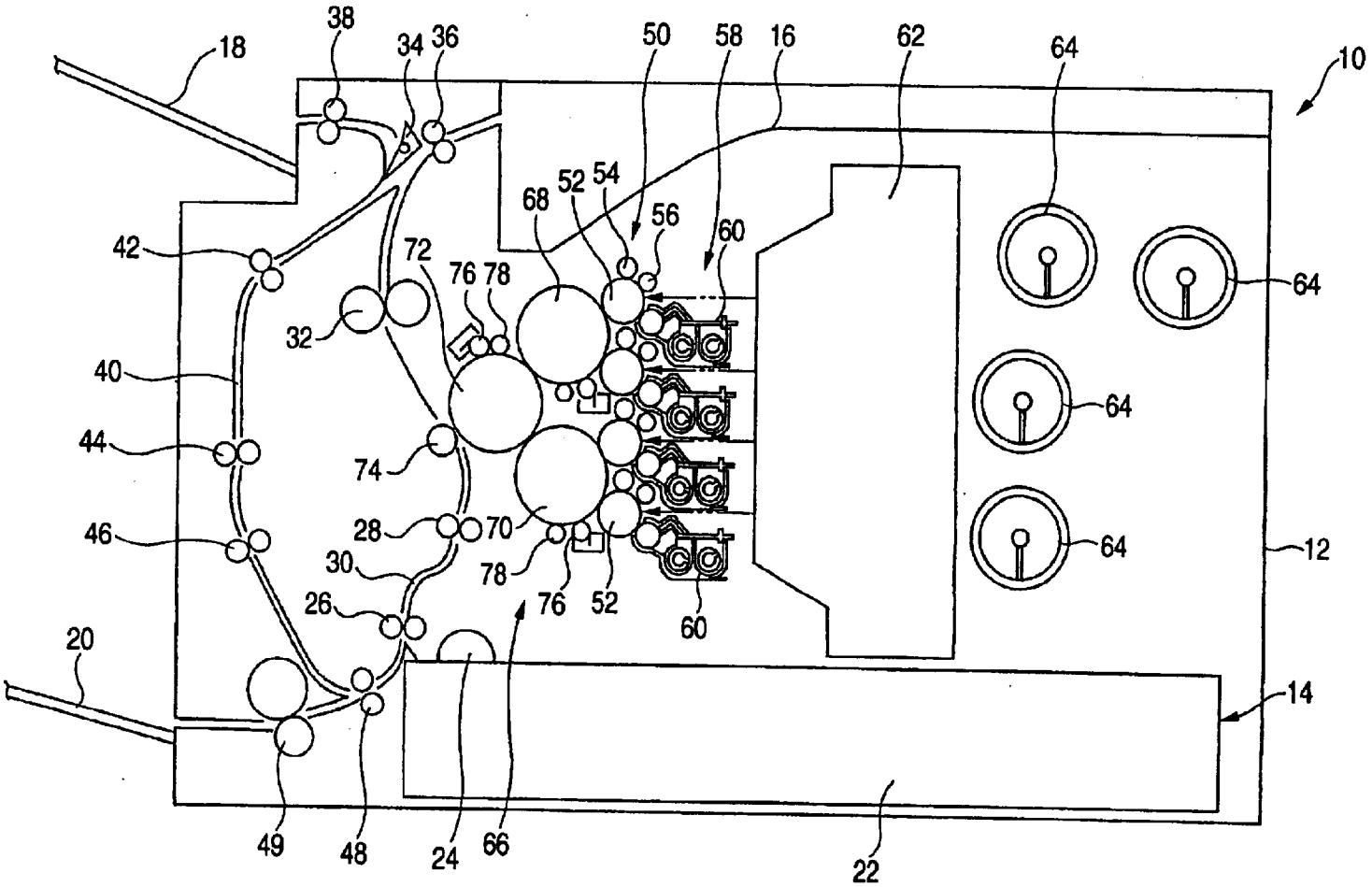
FIG. 1 is a side view to show an image formation apparatus according to an embodiment of the invention.

FIG. 1 shows an outline of an image formation apparatus 10 according to an embodiment of the invention. The image formation apparatus 10 has an image formation apparatus main unit 12, a paper feed unit 14 placed at the bottom of the image formation apparatus main unit 12, and an ejection tray 16 formed on the top of the image formation apparatus main unit 12. A second ejection tray 18 is placed on the left side of the image formation apparatus main unit 12 opposed to the first ejection tray 16, and a manual feed tray 20 is placed at a lower part of the left side of the image formation apparatus main unit 12.

The paper feed unit 14 has a paper tray 22 on which paper is stacked, and a paper feed roll 24 for delivering paper from the paper tray 22. Paper delivered by the paper feed roll 24 is transported on a paper feed passage 30 through transport rolls 26 and 28 and is sent to a transfer roll 74 described later. A toner image is transferred by the transfer roll 74 and is fixed on a fixing roll 32. The first ejection tray 16 or the second ejection tray 18 is selected in accordance with position selection of a switch claw 34 and the paper is ejected by ejection rolls 36 and 38. The paper is ejected to the first ejection tray 16 with the side on which the toner image is fixed as the back, and the paper is ejected to the second ejection tray 18 with the side on which the toner image is fixed as the face.

However, to perform double-sided print, for the paper being about to be ejected from the first ejection tray 16, the ejection roll 36 is reversely rotated for supplying the paper to a reversal passage 40 and the paper is returned to the paper feed passage 30 by transport rolls 42, 44, 46, and 48 for printing the back side. Paper on the manual feed tray 20 is supplied by a manual feed roll 49 and is sent to the paper feed passage 30 through the transport roll 48.

A photoconductor unit 50 has four photoconductors 52 arranged in a longitudinal direction for yellow, magenta, black, and cyan, for example, from the top to the bottom. A refresh roll 54 and a charging roll 56 are provided for each of the photoconductors 52 so as to come in contact with the corresponding photoconductor 52 for rotation.

A developing machine unit 58 is placed on the right of the photoconductor unit 50 and has four developing machines 60 arranged in the longitudinal direction in a one-to-one correspondence with the photoconductors 52. Each developing machine 60 adopts a trickle developing system, and an extra developer is collected into a collection vessel described later. A light exposure unit 62 is placed on the right of the developing machine unit 58 for emitting four laser beams responsive to an image signal to the photoconductors 52 for forming a latent image thereon. Four developer cartridges 64 are placed on the right of the light exposure unit 62. The developer cartridges 64 and the developing machines 60 are connected by developer supply passages (not shown) for supplying developers from the developer cartridges 64 to the developing machines 60.

An intermediate transfer unit 66 is placed on the left of the photoconductor unit 50 and has three intermediate transfer bodies 68, 70, and 72 shaped like drums. The two first intermediate transfer bodies 68 and 70 are arranged in the longitudinal direction. The upper first intermediate transfer body 68 comes in contact with the two upper photoconductors 52 and 52 for rotation and the lower first intermediate transfer body 70 comes in contact with the two lower photoconductors 52 and 52 for rotation. The second intermediate transfer body 72 comes in contact with both the first intermediate transfer bodies 68 and 70 for rotation, and the transfer roll 74 comes in contact with the second intermediate transfer body 72 for rotation. Therefore, two color toner images are transferred from the two photoconductors 52 and 52 to the first intermediate transfer bodies 68 and 70, and the two color toner images transferred to the first intermediate transfer body 68 and the two color toner images transferred to the first intermediate transfer body 70 are transferred to the second intermediate transfer body 72 to form a four-color toner image, which is then transferred to paper by the transfer roll 74. A cleaning roll 76 and a cleaning brush 78 are placed on each of the intermediate transfer bodies 68, 70, and 72. Toner caught by the cleaning roll 76 is scraped off, for example, with a blade, and the scraped-off toner is collected into the collection vessel described later. That is, the image formation apparatus main unit 12 has the four developing machines 60 and the three intermediate transfer bodies 68, 70, and 72, namely, comprises seven collected developer occurrence sections in total.

Figure 2:
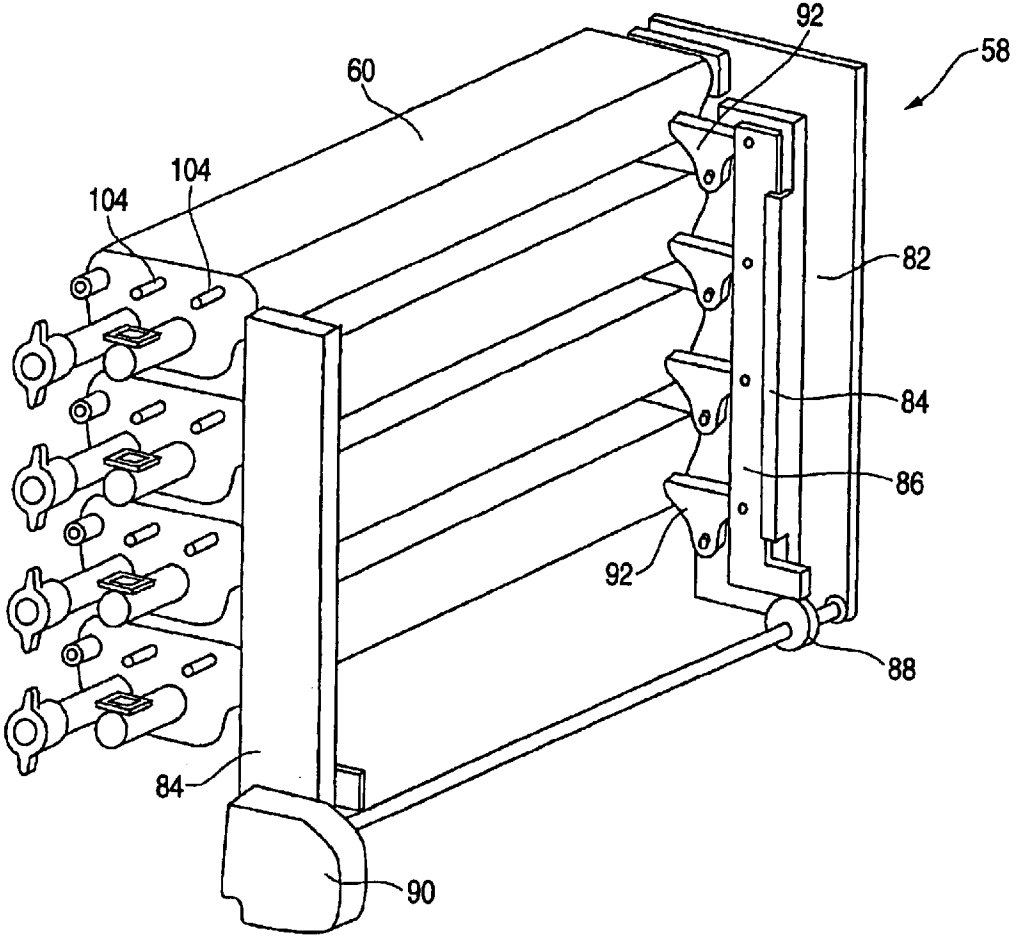
FIG. 2 is a perspective view to show a developing machine unit used with the image formation apparatus according to the embodiment of the invention.
Figure 3:
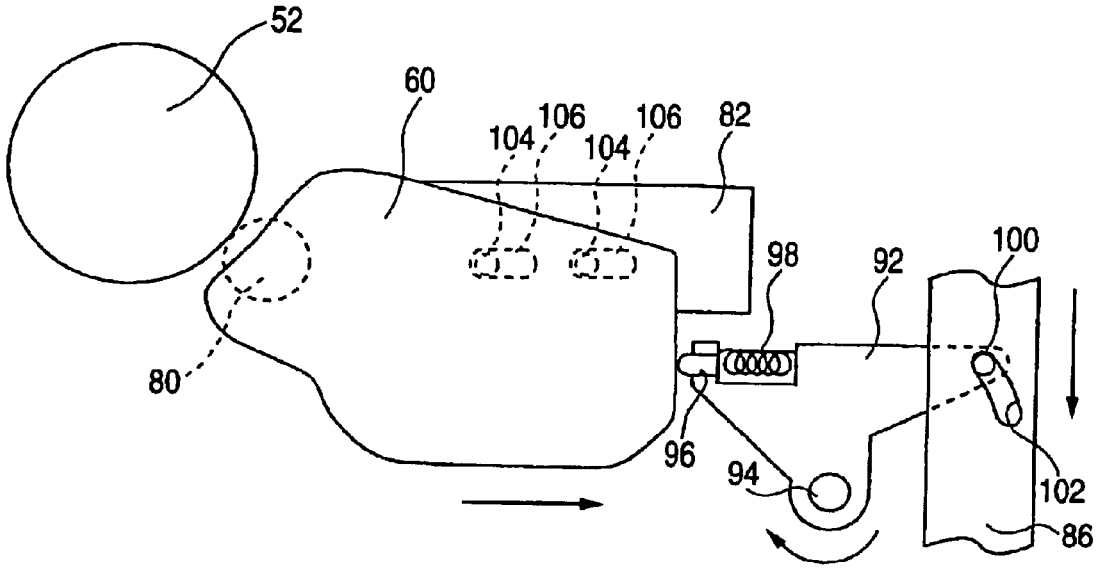
FIG. 3 is a side view to show a part of the developing machine unit used with the image formation apparatus according to the embodiment of the invention.
Figure 4:
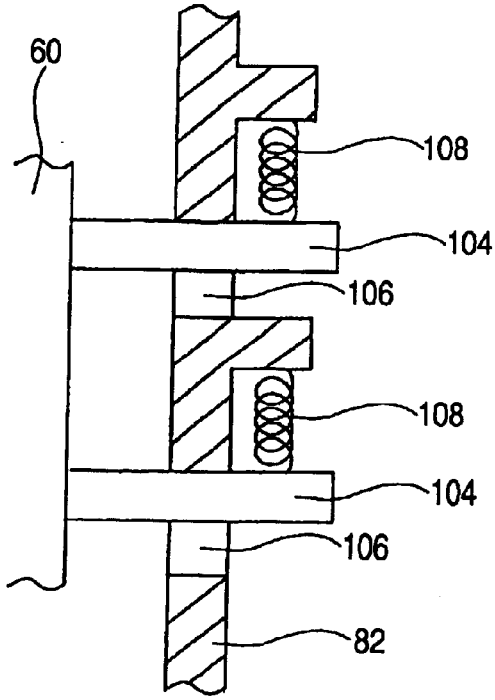
FIG. 4 is a sectional view to show a part of the developing machine unit used with the image formation apparatus according to the embodiment of the invention.

FIGS. 2 to 4 show the developing machine unit 58 in detail. The developing machine unit 58 can be moved between a position where a magnet roll 80 of the developing machine 60 abuts the photoconductor 52 and a position where the magnet roll 80 is retreated from the photoconductor 52. When an image is formed, the magnet roll 80 is abutted against the photoconductor 52 and toner is deposited on the photoconductor 52 in response to the latent image formed on the photoconductor 52. When image formation is not conducted, the magnet roll 80 of the developing machine 60 is retreated from the photoconductor 52 to prevent toner from being deposited on the photoconductor 52 to produce color mixture, for example, in a cleaning cycle or to prevent the photoconductor 52 and the magnet roll 80 from coming in contact with each other to make a scratch, etc., when the developing machine unit 58 is replaced.

The developing machine unit 58 comprises a rail member 84 in a developing machine unit main body 82, and a moving piece 86 is supported on the rail member 84 so that the moving piece 86 can be moved up and down. A cam 88 abuts the lower end of the moving piece 86 and is connected to a developing machine moving motor 90. A drive member 92 is placed between the moving piece 86 and the developing machine 60. The drive member 92 is supported on the rail member 84 through a fulcrum pin 94 for rotation and abuts the developing machine 60 through a press pin 96 placed at one end of the drive member 92, and the press pin 96 is pressed by a first press spring 98 for elastically pressing the developing machine 60. A rotation pin 100 placed at an opposite end of the drive member 92 is fitted in to a reception groove formed on the moving piece 86, so that as the moving piece 86 is moved down, the drive member 92 is rotated clockwise and moves away from the developing machine 60. Slide pins 104 are placed on both sides of the developing machine 60 and are inserted slidably into slide grooves 106 made in the developing machine unit main body 82. Further, the developing machine unit main body 82 is provided with second press springs 108 for pressing the slide pins 104 in a direction in which the developing machine 60 is away from the photoconductor 52.

Therefore, if the developing machine moving motor 90 is driven from the state in FIG. 3 for moving down the moving piece 86, the drive member 92 is rotated clockwise with the fulcrum pin 94 as a supporting point for weakening the press force of the first press spring 98 against the developing machine 60, and the press force of the second press spring 108 overcomes the press force of the first press spring 98, moving the developing machine 60 away from the photoconductor 52.

Figure 5:
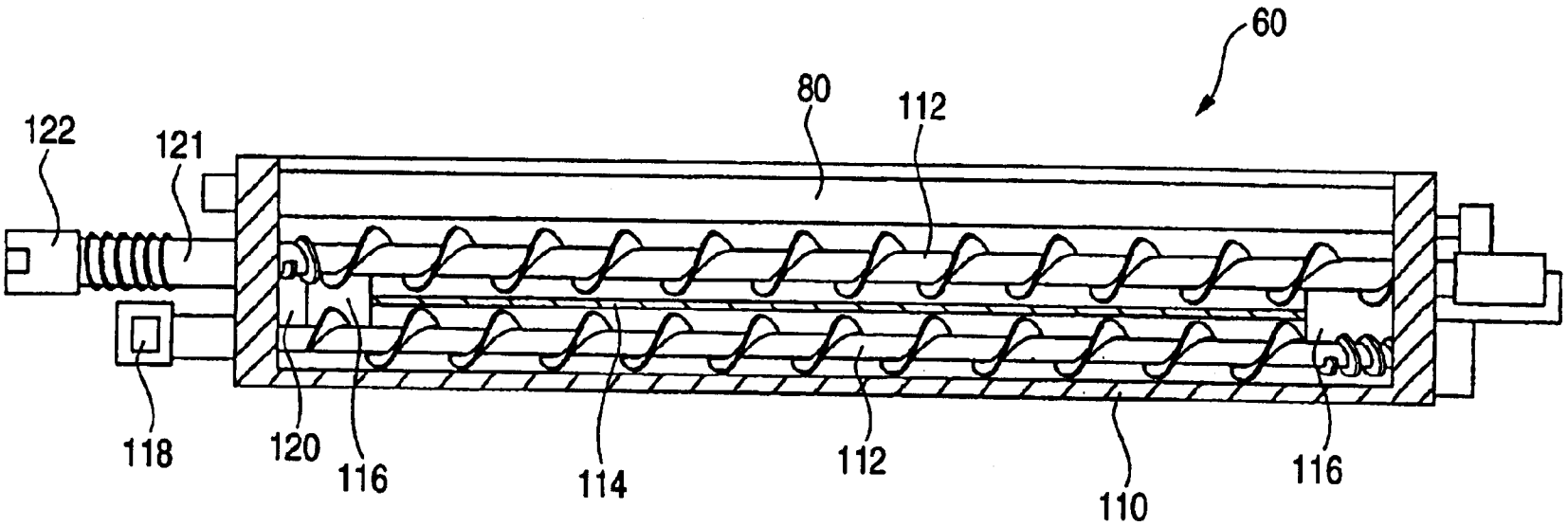
FIG. 5 is a sectional view to show a developing machine used with the image formation apparatus according to the embodiment of the invention.
Figure 6:
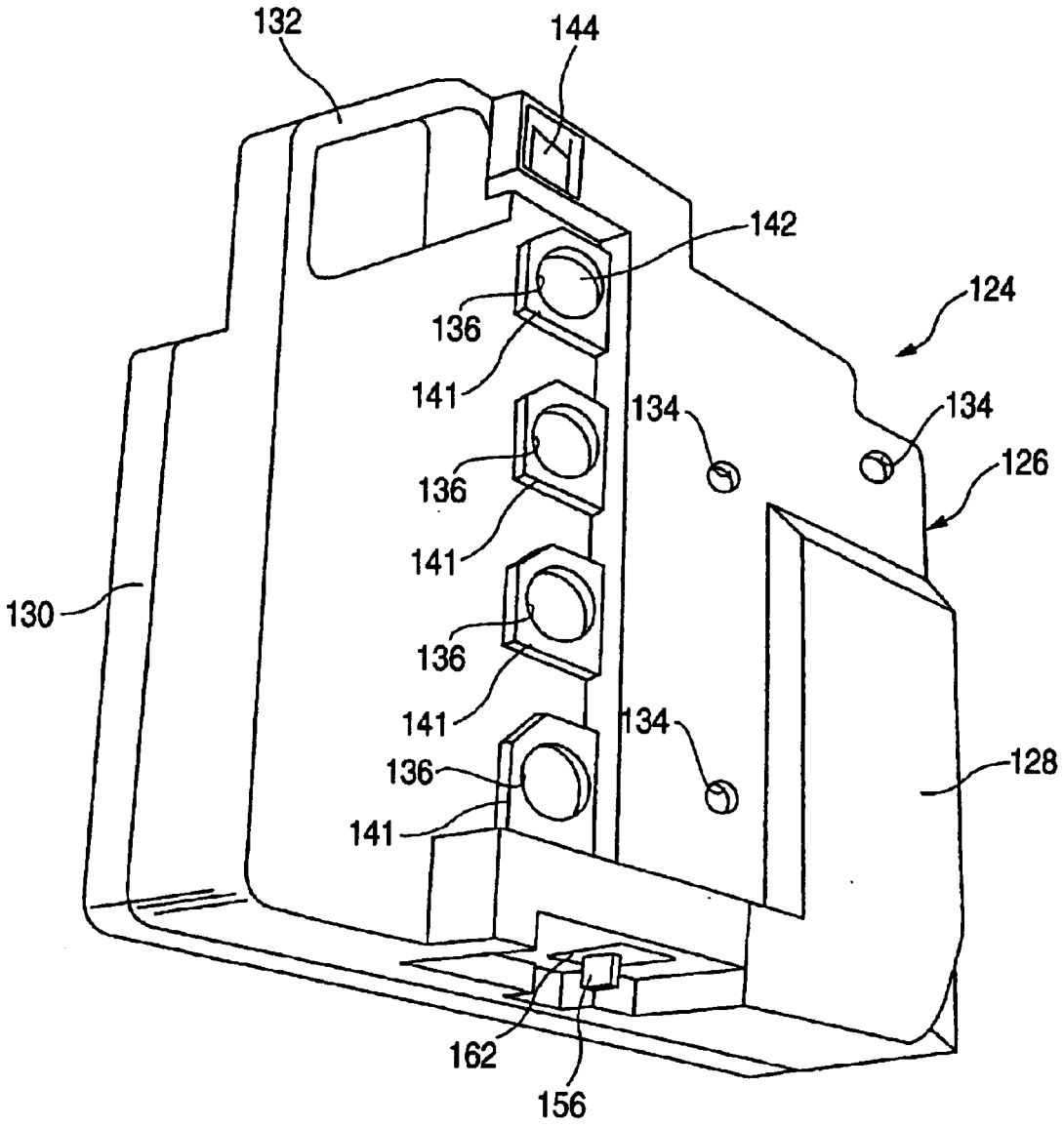
FIG. 6 is a perspective view to show the back side of a collection vessel used with the image formation apparatus according to the embodiment of the invention.
Figure 7:
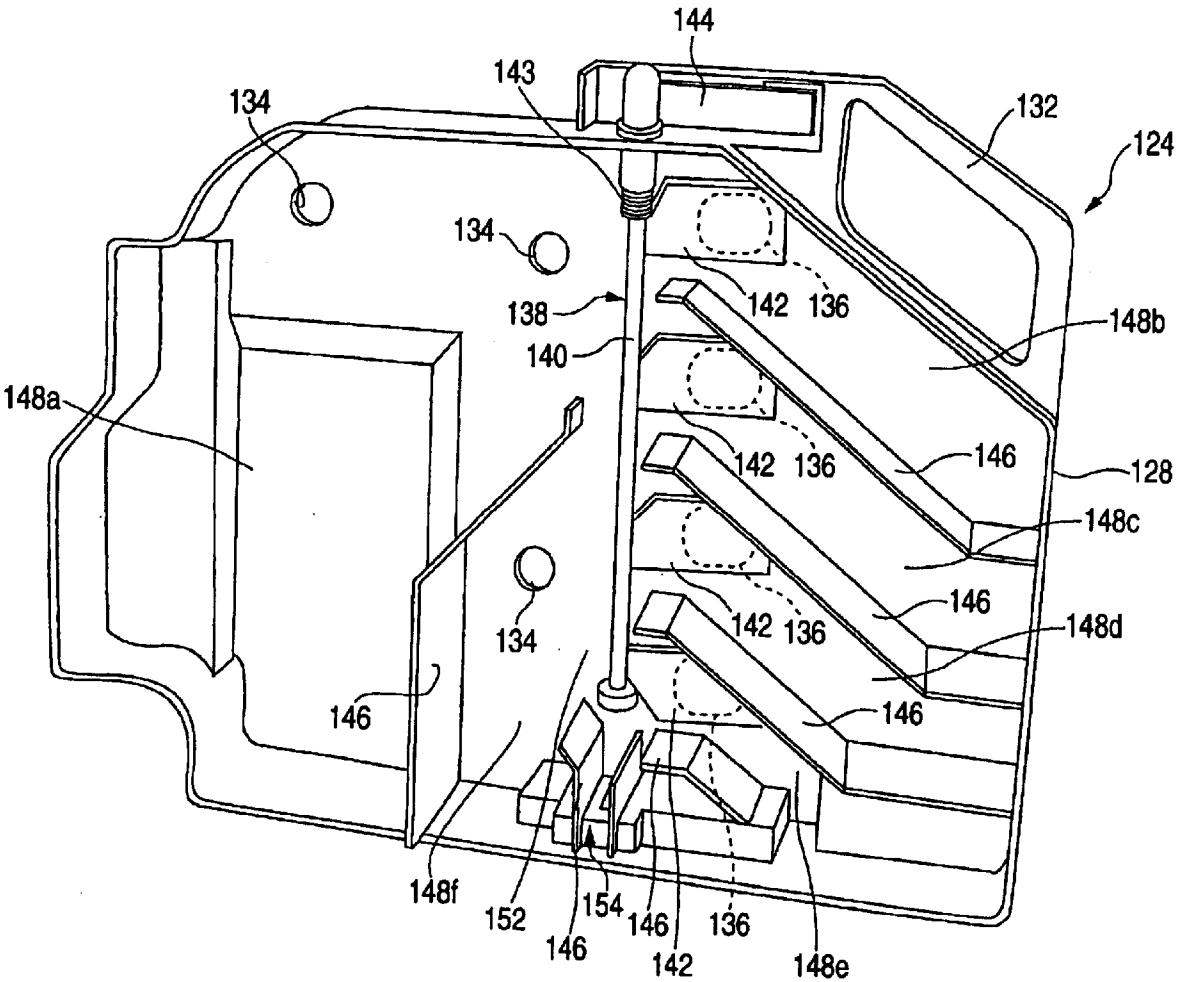
FIG. 7 is a perspective view to show a first housing of the collection vessel used with the image formation apparatus according to the embodiment of the invention.
Figure 8:
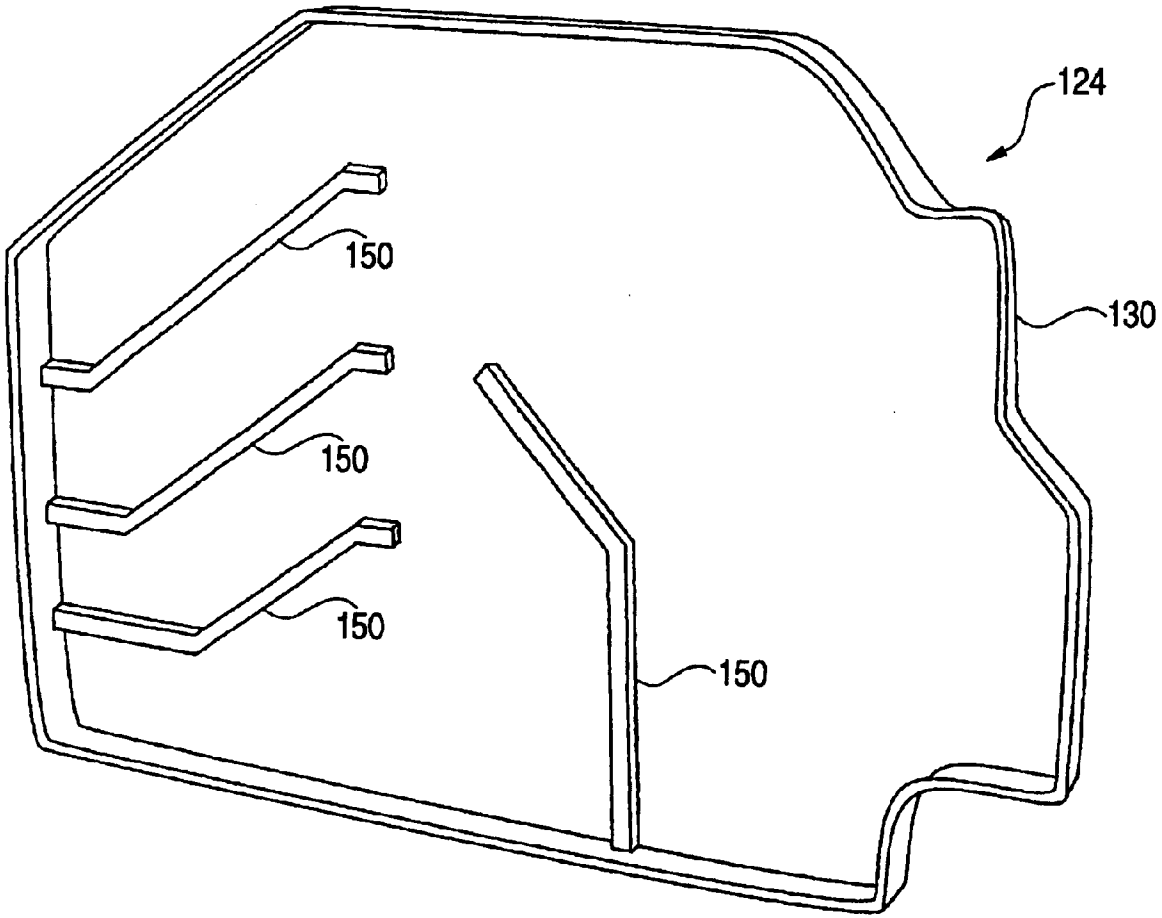
FIG. 8 is a perspective view to show a second housing of the collection vessel used with the image formation apparatus according to the embodiment of the invention.

FIG. 5 shows an example of the developing machine 6. The developing machine 60 adopts a trickle developing system as described above, and the magnet roll 80 and two spiral augers 112 are supported in a developing machine main body 110 for rotation. The two spiral augers 112 rotate in opposite directions and are partitioned by a partition wall 114 and are connected through circulation ports 116 and 116 formed in the vicinity of both end parts for circulating a developer entering the developing machine main body 110 in the developing machine main body 110 and supplying the developer to the magnet roll 80. The developing machine main body 110 is formed at one end with a step part 120 forming a collected developer occurrence section. Some of the circulated developer is taken into the step part 120 and further the taken-in developer is sent to a discharge section 122, which is connected via a developer discharge passage 121 to a collection port of the collection vessel described later. In the embodiment, the developer discharge passage 121 forms a collected developer occurrence section and the developer entering the developer discharge passage 121 does not function as developing action and is collected into the collection vessel.

FIGS. 6 to 9 show an example of collection vessel 124. The collection vessel 124 has a collection vessel main unit 126. The collection vessel main unit 126 is made up of a first housing 128 shown in FIG. 7 and a second housing 130 shown in FIG. 8, which are fitted into each other in peripheral portions thereof and are joined so that the collection vessel 124 can be easily disassembled and assembled with adhesive tape, etc., for example. The first housing 128 has a grip 132 in an inclined surface portion formed in the upper right part of the first housing 128. The first housing 128 is formed with three intermediate transfer body collection ports 134 corresponding to the collected developer occurrence sections of the intermediate transfer bodies and four developing machine collection ports 136 corresponding to the collected developer occurrence sections of the developing machines. One of the three intermediate transfer body collection ports 134 is formed in an upper end part of the collection vessel main unit 126; the remaining two are arranged in the longitudinal direction and one of the two intermediate transfer body collection ports 134 is formed below the longitudinal half position of the collection vessel main unit 126. The four developing machine collection ports 136 are arranged in the longitudinal direction, two of which are formed below the longitudinal half position of the collection vessel main unit 126.

Each developing machine collection port 136 is a long hole made long from side to side. The first housing 128 is provided with a shutter 138 for closing the developing machine collection ports 136. The shutter 138 has a rotation shaft 140 supported on the first housing 128 for rotation, four door parts 142 fixed to the rotation shaft 140, and a return spring 143 for urging the shutter 138 in a closing direction, and can open and close the four developing machine collection ports 136 by one operation as the rotation shaft 140 is rotated. An opening/closing piece 144 is provided in a projection portion of the rotation shaft 140 from the first housing 128. The opening/closing piece 144 is pressed by a protrusion of the image formation apparatus main unit, opening the shutter 138 as described later.

On the outer peripheral surface of each developing machine collection port 136, an elastic body 141 of a sponge, etc., for preventing a developer from spilling is attached to the first housing 128.

In the embodiment, each developing machine collection port 136 is made long from side to side because the developing machine is moved from side to side. If the developing machine is moved up and down, etc., the developing machine collection port 136 may be shaped accordingly; in short, it may be any shape for allowing the discharge section to move. A shutter is omitted for the intermediate transfer body collection ports 134, but can be provided for making it possible to open and close the intermediate transfer body collection ports 134 as with the developing machine collection ports 136.

The inside of the collection vessel main unit 126 is divided into six collection spaces 148*a* to 148*f*, for example, by partition walls placed upright in the first housing 128. A side end part of the partition wall 146 abuts a seal part 150 placed in the second housing 130. The seal part 150 is made of an elastic body and as the side end part of the partition wall 146 abuts the seal part 150, the side part 150 hermetically seals a side part of each collection space 148*a* to 148*f* for preventing the developer in the collection space from moving to any other collection space. The intermediate transfer body collection ports 134 and 134 placed in the upper parts are connected to the first collection space 148*a* for collecting collected developers occurring from the upper first intermediate transfer body 68 and the second intermediate transfer body 72 (two color toners and four color toners). The developing machine collection ports 136 are connected to the second to fifth collection spaces 148*b* to 148*e* for collecting yellow developer (yellow toner and carrier) into the second collection space 148*b*, magenta developer (magenta toner and carrier) into the third collection space 148*c*, black developer (black toner and carrier) into the fourth collection space 148*d*, and cyan developer (cyan toner and carrier) into the fifth collection space 148*e*. Further, the intermediate transfer body collection port 134 placed in the lower part is connected to the sixth collection space 148*f* for collecting collected developer occurring from the lower first intermediate transfer body 70 (two color toners). Therefore, to collect the collection vessel 124, the collected developers are separated according to the type of developer and it is convenient to reuse the developers.

The partition walls 146 may be those for completely hermetically sealing the collection spaces 148*a* to 148*f*. In the embodiment, however, the tip of each partition wall 146 stops in the vicinity of the rotation shaft 140 of the shutter 138 and thee collection spaces communicate through a communication part 152 formed in the collection vessel main unit 126 in the vicinity of the rotation shaft 140. The tip of the partition wall 146 is positioned below the lower end of the collection port 134, 136. Therefore, the developer collected through the collection port 134, 136 piles up from the lower end of the collection space 148*a* to 148*f*, and is stored therein until a part of the developer spills from the tip of the partition wall 146. The developer capacity until the developer spills from the collection space 148*a* to 148*f* is called collection capacity. The collection capacities of the collection spaces 148*a* to 148*f* are defined based on the shapes and heights of the partition walls 146; they are set so as to become a collection capacity ratio almost equal to the ratio of the collected developers occurring in the seven collected developer occurrence sections. In the embodiment, the collection capacity ratio of the first collection space 148*a*, the total of the second to fifth collection spaces 148*b* to 148*e*, and the sixth collection space 148*f* is set to about 5:4:1 provided that the sixth collection space 148*f* first becomes full.

In the embodiment, the collection spaces 148*a* to 148*f* are made to communicate through the communication part 152 at the tips of the partition walls 146. However, as another embodiment, the partition wall 146 may be formed with a hole, a groove, etc., for allowing the collection space to communicate with any other collection space and it is not necessary to make all collection spaces communicate with each other; it may be sufficient to make at least two collection spaces communicate with each other.

Figure 9:
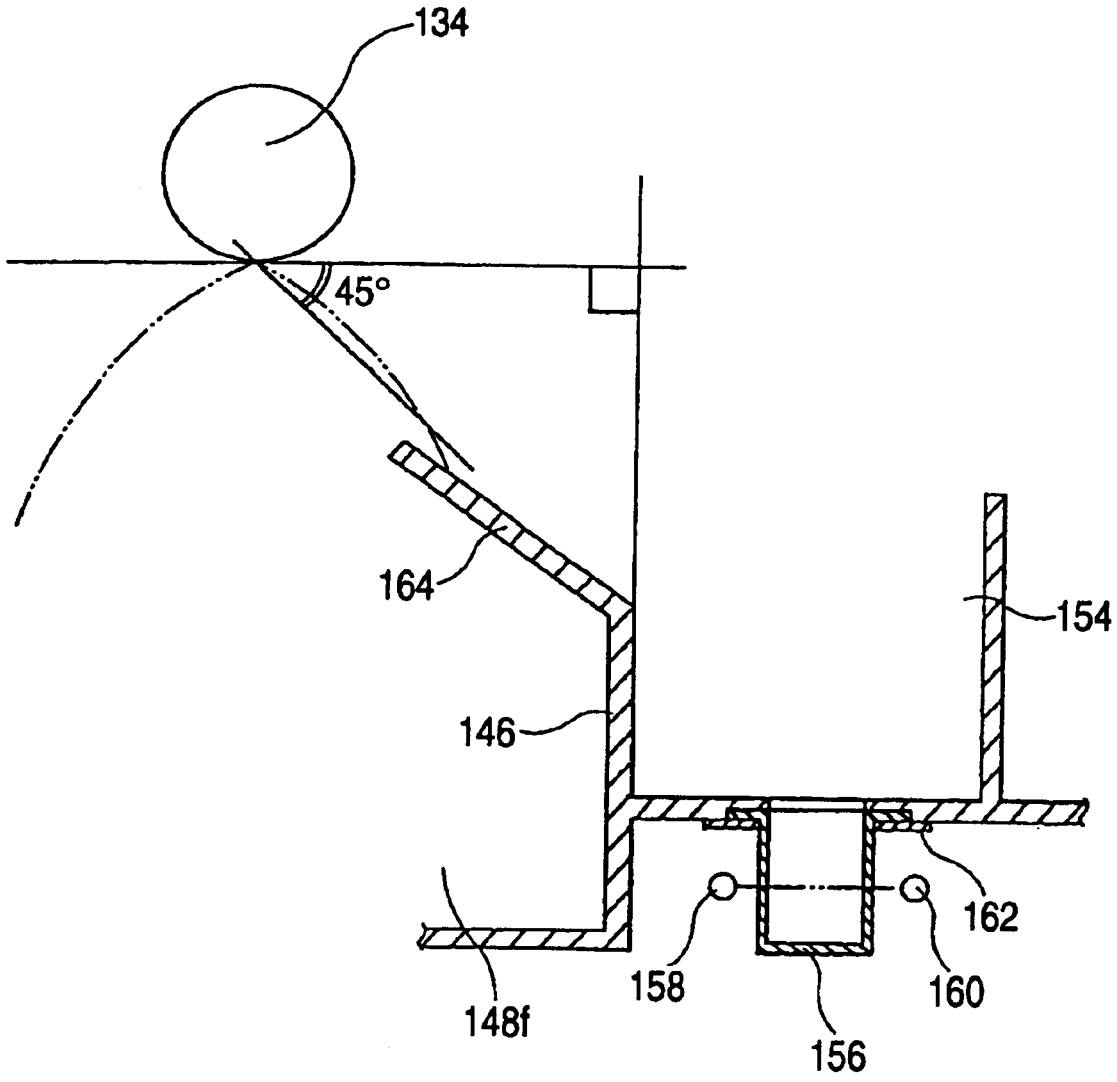
FIG. 9 is a sectional view to show a part of the collection vessel used with the image formation apparatus according to the embodiment of the invention.

A developer intake section 154 implementing a full condition detector is placed in a bottom portion of the collection vessel main unit 126 so as to be adjacent to the sixth collection space 148*f* in a lower part of the communication part 152. The developer intake section 154 has a translucent detection vessel 156 as shown in FIG. 9. When a given amount or more of developer is entered in the detection vessel 156, light emitted from a light emission section 158 placed in the image formation apparatus main unit is blocked and is not received at a light reception section 160, whereby the full condition detector detects the collection space becoming full. The detection vessel 156 is joined by joint means 162 that can be easily attached and detached, such as adhesive tape.

As shown in FIG. 9, the partition wall 146 defining the collection capacity of the sixth collection space 148*f* has a slope part 164 with a tip directed to the collection port 134, and is formed so that the tip of the partition wall 146 is positioned in the range below the 45-degree line from the horizontal line with the top of the developer as the start point when the top of the developer piled up on the sixth collection space 148*f* reaches the lower end of the collection port 134. The slope part 164 is formed so as to go to the collection port 134 at an angle of less than 90 degrees from the horizontal line. Therefore, the collected developer which is about to fill the collection space is guided from the tip of the partition wall 146 through the slope part 164 to the developer intake section 154 before the collected developer reaches the lower end of the collection port 134; the full condition detector can reliably detect the collection space being full of the developer and an accident clogging the developer, etc., can be prevented.

As described above, the collection capacity ratio of the collection spaces 148*a* to 148*f* is set so that the sixth collection space 148*f* first becomes full. However, if variation in the collection amounts or an unexpected event occurs in the image formation apparatus main unit, any other collection space 148*a* to 148*e* may become full earlier than the sixth collection space 148*f*. Even in this case, the developer overflowing any other collection space 148*a* to 148*e* can be introduced into the developer intake section 154 through the communication part 152, and a full condition can be detected reliably.

Next, attaching the collection vessel 124 to the image formation apparatus main unit 12 will be discussed with reference to FIGS. 10 to 14.

Figure 10:
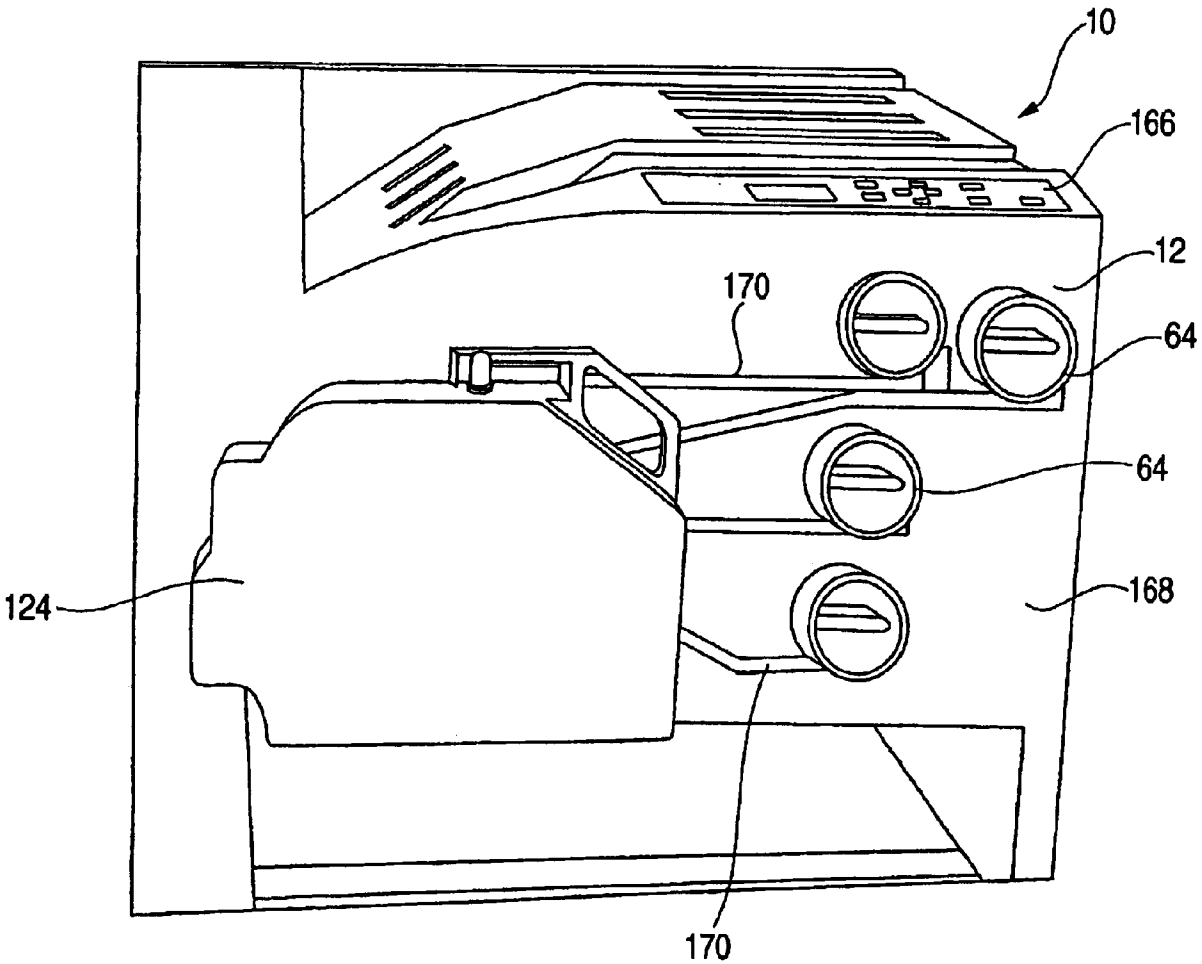
FIG. 10 is a perspective view to show a state of placing the collection vessel on an image formation apparatus main unit with a front panel removed in the image formation apparatus according to the embodiment of the invention.
Figure 11:
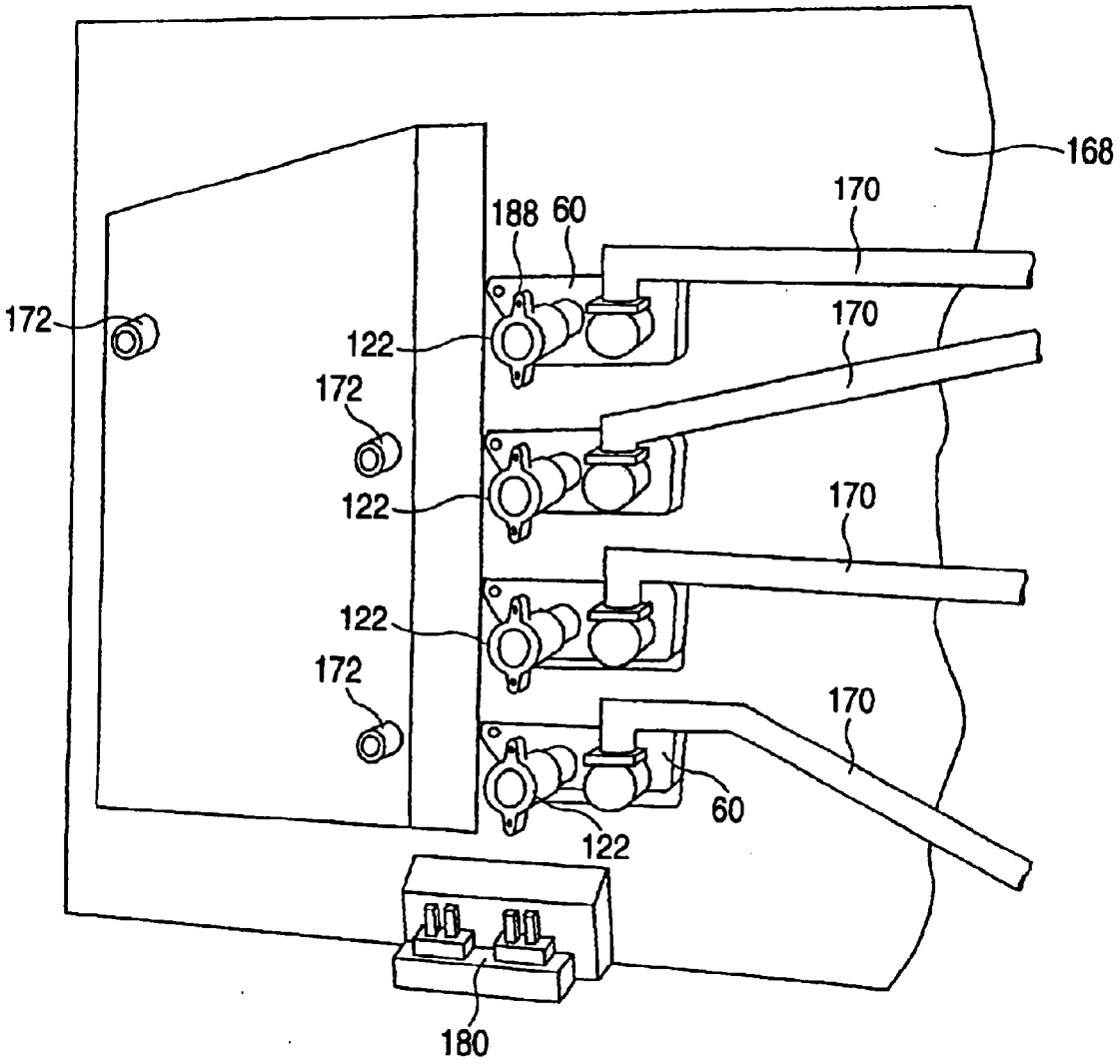
FIG. 11 is a perspective view to show the image formation apparatus main unit excluding a front panel, the collection vessel, and a second frame in the image formation apparatus according to the embodiment of the invention.
Figure 12:
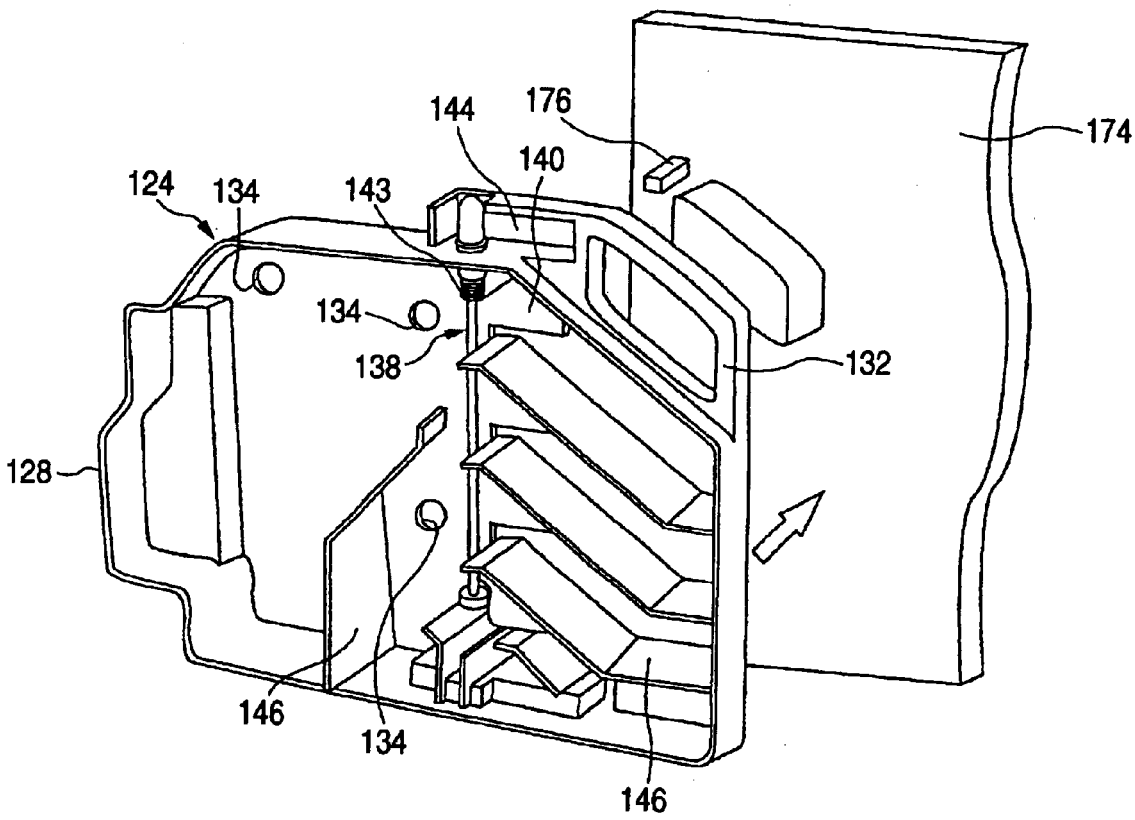
FIG. 12 is a perspective view to show the relationship between the collection vessel and a second frame in the image formation apparatus according to the embodiment of the invention.
Figure 13:
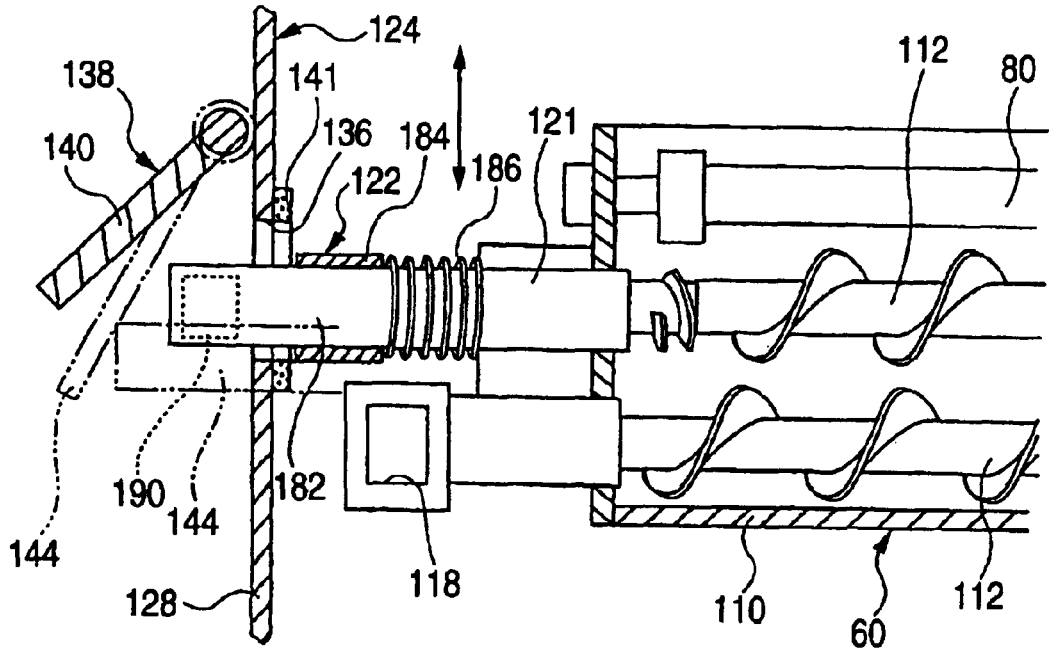
FIG. 13 is a transverse sectional view to show the relationship between a developing machine and the collection vessel in the image formation apparatus according to the embodiment of the invention.
Figure 14:
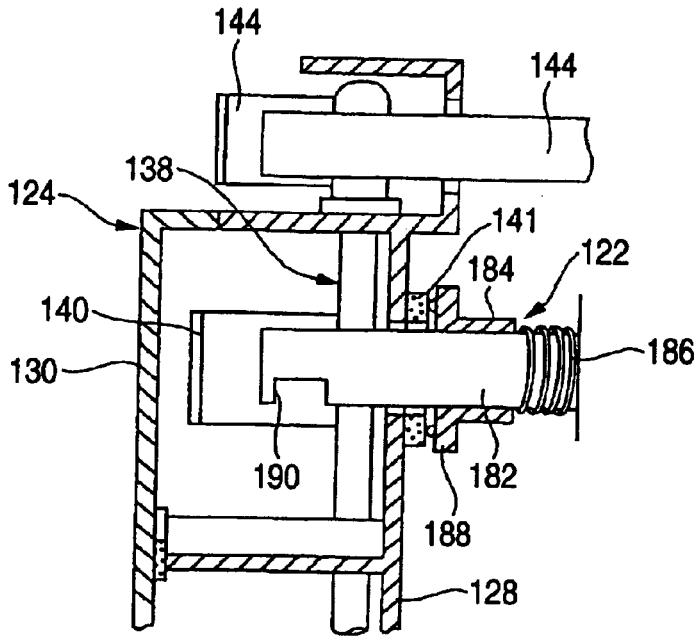
FIG. 14 is a longitudinal sectional view to show the relationship between the developing machine and the collection vessel in the image formation apparatus according to the embodiment of the invention.

The collection vessel 124 is attached to the front of the image formation apparatus main unit 12. Here, the front of the image formation apparatus main unit 12 refers to the face on which a control panel 166 is placed, as shown in FIG. 10. As a front cover (not shown) is opened, the collection vessel 124 can be found and can be attached and detached. The image formation apparatus main unit 12 is provided with a first frame and developer supply hoses 170 are placed along the first frame 168. Each developer supply hose 170 forms a developer supply passage for connecting the corresponding developing machine 60 and the corresponding developer cartridge 64. From the first frame 168, the discharge sections 122 of the developing machines 60 and discharge sections 174 connected to cleaning roll parts of the intermediate transfer unit are projected toward the front of the image formation apparatus main unit 12 almost in parallel, and are connected to the collection ports 134 and 136 of the collection vessel 124.

A second frame 174 is fixed to the front of the first frame 168 and is formed with a protrusion 176. The protrusion 176 is placed facing the opening/closing piece 144 of the shutter 138 in the collection vessel 124, and the opening/closing piece 144 and the protrusion 176 make up retreat means. To place the collection vessel 124 on the image formation apparatus main unit 12, the protrusion 176 abuts the opening/closing piece 144 and presses the opening/closing piece 144 in a direction opening the shutter 138, opening the shutter against the return spring 143. The angle at which the shutter 138 is opened is set wide so that the discharge sections 122 do not abut the door parts 142 of the shutter 138. A sensor section 180 forming the full condition detector is placed in a lower part of the first frame 168.

The protrusion 174 is formed on the image formation apparatus main unit 12, but may be formed on the shutter 138 as another embodiment.

The discharge section 122 of each developing machine 60 has a discharge pipe 182 connected to the developer discharge passage 121, an open/close sleeve 184 slidably externally fitted into the discharge pipe 182, and an opening/closing spring 186 for pressing the open/close sleeve 184 in the tip direction. To place the collection vessel 124 on the image formation apparatus main unit 12, a flange 188 formed on the open/close sleeve 184 abuts the elastic body 141 of the collection vessel 124, the open/close sleeve 184 backs against the opening/closing spring 186, the tip of the discharge pipe 182 is inserted into the collection vessel 124 from the developing machine collection port 136, and a discharge port 190 formed in the vicinity of the tip of the discharge pipe 182 is opened, allowing the collected developer from the developing machine 60 to be collected into the collection vessel 124 through the discharge port 190.

The discharge sections 122 of the developing machines 60 are thus connected to the collection vessel 124. At this time, the shutter 138 is already opened by the protrusion 176 and the discharge sections 122 do not abut the door parts 142 of the shutter 138.

However, the collection vessel 124 is not necessarily placed straightly on the image formation apparatus main unit 12. Thus, to place the collection vessel 124 slantingly on the image formation apparatus main unit 12, the tips of the discharge pipes 182 of the discharge sections 122 first abut the door parts 142 and the shutter 138 is opened so as not to hinder opening the shutter 138.

Further, then the developing machines 60 are moved in the photoconductor direction as described above. Also at this time, the shutter 138 is opened to the angle at which the discharge sections 122 do not abut the door parts 142 of the shutter 138. Therefore, a force of hindering motion of the developing machines 60 does not act from the shutter 138 and the developing machines 60 can be moved smoothly.

The operation of the image formation apparatus 10 according to the embodiment is as follows:

Upon reception of an external image formation signal, for example, the paper feed roll 24 of the paper feed unit 14 works and paper is sent from the paper feed tray 22 via the paper feed passage 30 to the transfer roll 74. On the other hand, the four rotating photoconductors 52 are uniformly charged by the charging rolls 56, laser light from the light exposure unit 62 is received in response to an image signal, and a latent image is formed. Next, color toner images are formed by the developing machines 60 and two colors are transferred to the first transfer body 68 and two colors are transferred to the first transfer body 70. Further, the four colors are transferred to the second intermediate transfer body 72 to form a four-color toner image, which is then transferred to paper by the transfer roll 74. The toner image transferred to the paper is fixed on the paper as the paper passes through the fixing roll 32, and the paper is discharged to the first ejection tray 16 or the second ejection tray 18.

In the developing machine 60, a little excessive developer is supplied from the developer cartridge 64 to a developer entrance 118 in response to the developer consumption amount. The supplied developer is circulated in the developing machine main unit 110 by the spiral augers 112 and is supplied to the magnet roll 80. The extra developer is caught by the step part 120 and is collected through the discharge section 122 into the collection vessel 124. The toners deposited on the intermediate transfer bodies 68, 70, and 72 are caught by the cleaning rolls 76 and are collected through the discharge sections 172 into the collection vessel 124.

The developers thus collected into the collection vessel 124 are stored separately in the collection spaces **148*a* to 148*f* in the collection vessel 124. When the developer collection amount of the collection spaces 148*a* to 148*f* becomes a predetermined amount or more (usually, the developer collection amount of the collection space 148*f* becomes a predetermined amount or more), the developer overflows the partition wall 146 and moves to the developer intake section 154. The developer entering the developer intake section 154 moves to the detection vessel 156. The sensor section 180 detects the collection space becoming full, and sends a detection signal to a control section of the image formation apparatus main unit 12 for displaying a full condition on the control panel 166, for example. Accordingly, the user can replace the collection vessel 124** with a new one for making it possible to again conduct image formation.

If the collection vessel 124 is detached from the image formation apparatus main unit 12 in a state in which the collection vessel 124 (collection space) is not full, since the grip 132 of the collection vessel 124 is placed slantingly, the developer spills from the partition wall 146 of the collection space **148*a* to 148*f* and enters the detection vessel 156. If the collection vessel 124 is later placed on the image formation apparatus main unit 12, a full condition may be detected. However, if the collection vessel 124 is once detached, there is a fear of leading to an accident of developer clogging, etc., in the image formation apparatus main unit 12; preferably a full condition is displayed for prompting the user to replace the collection vessel 124**.

Figure 15:
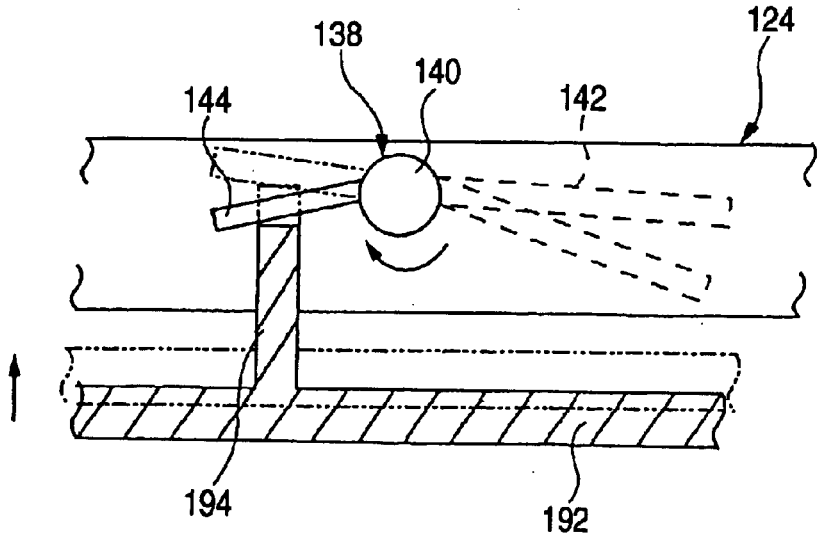
FIG. 15 is a plan view partly in section to show an image formation apparatus according to another embodiment of the invention.

FIG. 15 shows another embodiment of the invention. In this embodiment, a shutter 138 is opened and closed in conjunction with opening and closing a front cover 192. That is, the shutter 138 comprises an opening/closing piece 144 placed on the opposite side to a door part 142 with a rotation shaft 140 as the center, and the front cover 192 is provided with a protrusion 194 facing the opening/closing piece 144. If the front cover 192 is closed, the protrusion 194 abuts the opening/closing piece 144, the rotation shaft 140 rotates against a return spring, and the door part 142 rotates on the rotation shaft 140. Before the front cover 192 is closed, a discharge section abuts the door part 142 and a developing machine collection port is opened. The shutter 138 is further opened by the protrusion 194 of the front cover 192 and the door part 142 of the shutter 138 can be retreated to a position where the discharge section does not abut the shutter 134 in the movable range of the discharge section.

In the embodiment, the image formation apparatus of the type wherein the collected developer occurrence sections are placed in the developing machines and the intermediate transfer bodies has been described. However, the collected developer occurrence sections are not limited to them; for example, collected developers occurring in the photoconductors, the transfer roll, etc., may be collected.

As described above, according to the invention, there is provided the retreat means for retreating the shutter to a position where the discharge section does not abut the shutter with the discharge section inserted in the collection port, so that pressure of the shutter can be prevented from being placed on the discharge section. The shutter opens and closes the collection ports in one piece, so that the number of parts can be lessened and the opening/closing mechanism can be simplified. Since the collection port is formed as the shape for allowing the discharge section to move, load can be prevented from being imposed on the collected developer occurrence section.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is, intended that the scope of the invention be defined by the claims appended hereto, and their equivalents.

What is claimed is:

1. An image formation apparatus comprising:

a collected developer occurrence section;

a discharge section connected to said collected developer occurrence section;

a collection vessel having a collection port into which said discharge section is inserted and a shutter urged in a direction closing the collection port; and a retreat use adapted to retreat the shutter to a position where said discharge section does not abut the shutter with said discharge section inserted in the collection port.

2. The image formation apparatus as claimed in claim 1 wherein said collected developer occurrence section is placed in a developing machine.

3. The image formation apparatus as claimed in claim 1 wherein said collected developer occurrence section is placed in an intermediate transfer body.

4. The image formation apparatus as claimed in claim 1 wherein said discharge section is moved in any other direction than the insertion axial direction of said discharge section into the collection port and the collection port is formed as a shape for allowing said discharge section to move.

5. The image formation apparatus as claimed in claim 4 wherein the shutter is retreated to a position where the shutter does not interfere with said discharge section in a movable range of said discharge section.

6. The image formation apparatus as claimed in claim 1 wherein the shutter is opened/closed as it abuts said discharge section.

7. The image formation apparatus as claimed in claim 1 further comprising a gang unit adapted to open and close the shutter in conjunction with opening and closing a cover placed on an image formation apparatus main unit.

8. An image formation apparatus comprising:

a plurality of collected developer occurrence sections;

a plurality of discharge sections connected to said plurality of collected developer occurrence sections; and a collection vessel having a plurality of collection ports into which said plurality of discharge sections are inserted and a shutter urged in a direction closing the plurality of collection ports, wherein the shutter opens and closes the plurality of collection ports in one piece.

9. An image formation apparatus comprising:

a collected developer occurrence section;

a discharge section being connected to said collected developer occurrence section; and a collection vessel formed with a collection port into which said discharge section is inserted, wherein said discharge section is moved in any other direction than the insertion axial direction of said discharge section into the collection port and the collection port is formed as a shape having a length greater than a width for allowing said discharge section to move.

10. An image formation apparatus comprising:

a photoconductor;

a developing machine being placed so that said developing machine can be brought into and out of contact with said photoconductor; and a collection vessel formed with a collection port into which a discharge section connected to a collected developer occurrence section placed in said developing machine is inserted, wherein the collection port is formed as a shape for allowing the discharge section to move as said developing machine is brought into and out of contact with said photoconductor.

11. A developer collection vessel comprising:

a collection port into which a discharge section where a developer is discharged is inserted and a shutter urged in a direction closing said collection port, wherein said shutter is retreated to a position where the discharge section does not abut said shutter with the discharge section inserted in said collection port.

12. The developer collection vessel as claimed in claim 11 wherein said collection port is formed as a shape for allowing the discharge section to move in any other direction than the insertion axial direction.

13. The developer collection vessel as claimed in claim 12 wherein said shutter is retreated to a position where said shutter does not interfere with the discharge section in a movable range of the discharge section.

14. The developer collection vessel as claimed in claim 11 wherein said shutter is also opened/closed as it abuts the discharge section.

15. A developer collection vessel comprising:

a plurality of collection ports each into which a discharge section where a developer is discharged is inserted and a shutter urged in a direction closing said plurality of collection ports, wherein said shutter opens and closes said plurality of collection ports in one piece.

16. A developer collection vessel comprising:

a collection port into which a discharge section where a developer is discharged is inserted, said collection port being formed as a shape having a length greater than a width for allowing the discharge section to move in any other direction than the insertion axial direction.

* * * * *